US005310270A

United States Patent [19]

Matsukura

[11] Patent Number: 5,310,270

[45] Date of Patent: May 10, 1994

[54] PRINTING METHOD FOR DOT IMPACT TYPE SERIAL PRINTER

[75] Inventor: Hiroyuki Matsukura, Tokyo, Japan

[73] Assignee: Nec Corporation, Tokyo, Japan

[21] Appl. No.: 56,949

[22] Filed: May 5, 1993

Related U.S. Application Data

[63] Continuation of Ser. No. 763,704, Sep. 23, 1991, abandoned.

[30] Foreign Application Priority Data

Sep. 21, 1990 [JP] Japan ..... 2-253724

[51] Int. Cl.[5] ..... B41J 2/22; B41J 29/10

[52] U.S. Cl. ..... 400/121; 400/661; 400/689

[58] Field of Search ..... 400/121, 124, 157.2, 400/689, 661, 661.1, 661.2, 661.3, 661.4, 662

[56] References Cited

U.S. PATENT DOCUMENTS

| | | | |
|---|---|---|---|
| 4,247,213 | 1/1981 | Würscher | 400/661 |
| 4,887,923 | 12/1989 | Ishikawa et al. | 400/661 |
| 4,984,917 | 1/1991 | Hauslaib et al. | 400/661.1 |
| 5,048,984 | 9/1991 | Kringe et al. | 400/124 |

FOREIGN PATENT DOCUMENTS

| | | | |
|---|---|---|---|
| 27734 | 4/1981 | European Pat. Off. | 400/124 |
| 6418 | 1/1977 | Japan | 400/124 |
| 7631 | 1/1977 | Japan | 400/124 |
| 59860 | 4/1983 | Japan | 400/124 |
| 55761 | 3/1984 | Japan | 400/124 |
| 159066 | 8/1985 | Japan | 400/124 |
| 72558 | 4/1988 | Japan | 400/124 |

*Primary Examiner*—Edgard S. Burr
*Assistant Examiner*—Stephen R. Funk
*Attorney, Agent, or Firm*—Sughrue, Mion, Zinn, Macpeak & Seas

[57] ABSTRACT

A dot impact type serial printer is provided with a print head which has a plurality of print wires for printing an image. The print wires required to print a particular image are thrust toward a platen successively upon receiving a print timing signal, where each print timing signal is delayed from the previous print timing signal by a predetermined time interval t. The delay of each print timing signal is based on the time required for a surface wave, caused by the impact of print wires on the platen, to pass lengthwise across the platen and is selected to be less than one-half the surface wave travel time.

2 Claims, 5 Drawing Sheets

PRINTING METHOD FOR DOT IMPACT TYPE SERIAL PRINTER

This is a Continuation of application Ser. No. 07/763,704 filed Sep. 23, 1991, now abandoned.

BACKGROUND OF THE INVENTION

The present invention relates to a dot impact type serial printer applicable to, for example, a computer output terminal.

It is a common practice with a conventional dot impact type serial printer to arrange the tips of print wires in a single array or in two or three parallel arrays. Selected print wires in the same array which match a desired print pattern are driven at the same time to impact against a platen.

Since the selected wires of each array impact against the platen at the same time, the surface of the platen is elastically deformed to a noticeable extent. Such deformations of the platen are sequentially propagated along the platen to produce surface waves having various frequency components. The surface waves are repetitively reflected at the ends of the platen and propagated back and forth along the surface of the platen. While the surface waves are so propagated back and forth, a standing wave, having the same period as the time in which the surface wave passes along the length of the platen, is generated in the surface of the platen.

The dot impact type serial printer continuously impacts the print wires thereof against the platen at a predetermined period. Hence, the surface waves are continuously generated and, when the impacting period is identical with the period of the standing wave, the surface waves cooperate with the standing wave. In this case, surface oscillation is stably occurred on the surface of the platen. Such surface oscillation constitutes the source of unpleasant noise.

SUMMARY OF THE INVENTION

It is, therefore, an object of the present invention to provide a dot impact type serial printer which is operable with a minimum of noise.

A dot impact type printer of the present invention has a platen for holding a sheet thereon, a print head having a plurality of print wires which face the platen to print out an image on the sheet, and drive means for driving successive ones of the print wires at an interval less than one half of the time in which a surface wave passes the platen in the lengthwise direction of the platen.

In accordance with the present invention, successive ones of the print wires are driven at the above-mentioned interval to impact against the platen. Hence, the amplitude of each surface wave is reduced. Moreover, since the interval is less than one half of the time in which the surface waves of the platen pass the platen in the lengthwise direction, the phase differences among the surface waves are smaller than 180 degrees of a basic component of the standing wave. The surface waves, therefore, cancel one another and do not cooperate with one another. This is successful in reducing the surface oscillation and, therefore, the noise, to a negligible degree.

BRIEF DESCRIPTION OF THE DRAWINGS

The above and other objects, features and advantages of the present invention will become more apparent from the following detailed description taken with the accompanying drawings in which.

DETAILED DESCRIPTION OF THE PREFERRED EMBODIMENT

Figure 1:
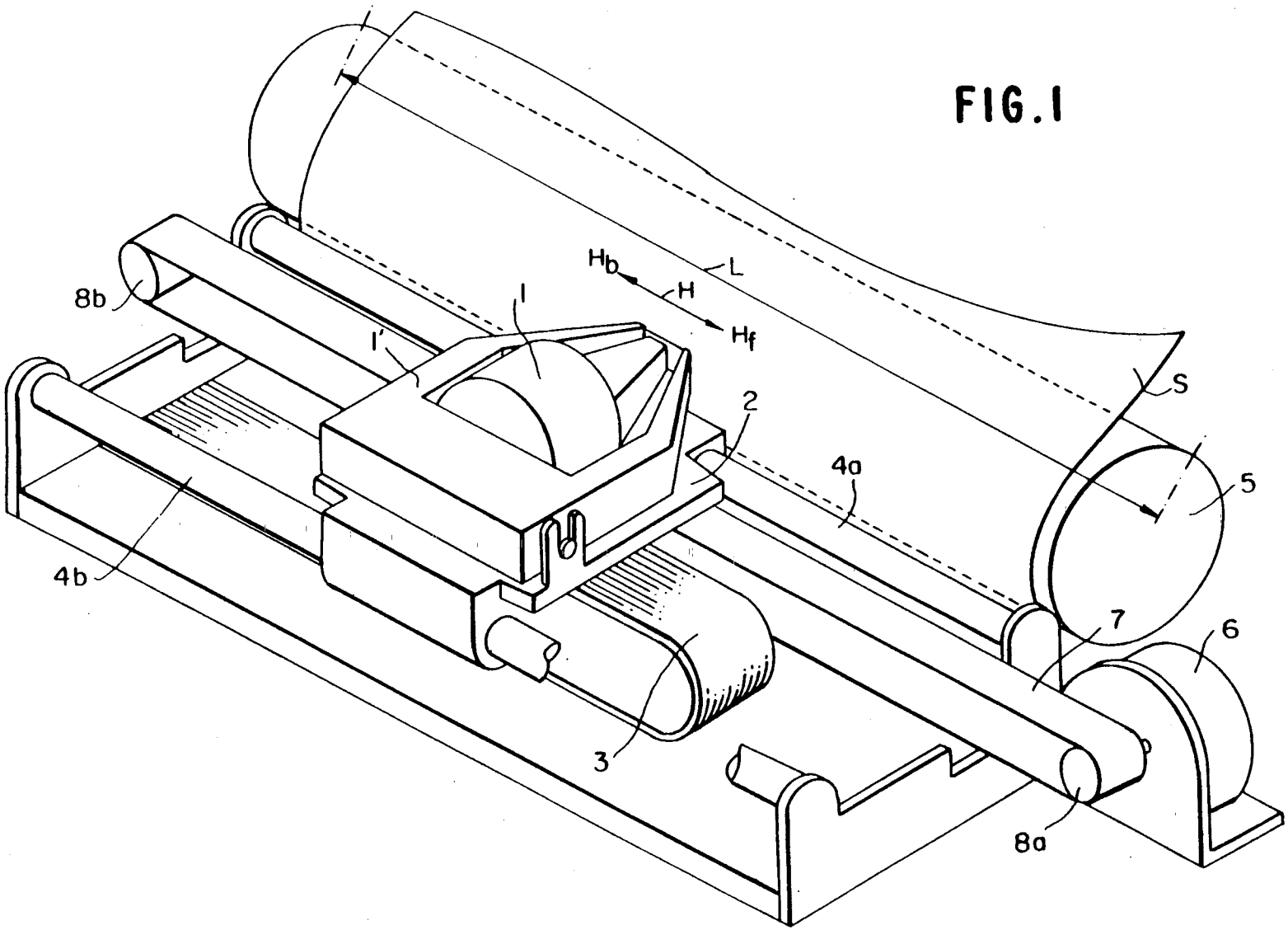
FIG. 1 is a perspective view showing an embodiment of the dot impact type serial printer in accordance with the present invention.

Referring to FIG. 1 of the drawings, a serial printer embodying the present invention includes a carriage 2. The carriage 2 is mounted on parallel guide shafts 4*a* and 4*b* and movable therealong in a reciprocating motion, as indicated by an arrow H in the figure. A print head 1 and an ink ribbon cassette 1' are mounted on the carriage 2. A drive pulley 8*a* is mounted on the output shaft of a motor 6. A belt 7 is passed over the drive pulley 8*a* and a driven pulley 8*b* in a loop configuration, and the carriage 2 is affixed to the belt 7. Driven by the motor 6 via the belt 7, the carriage 2, i.e., the print head 1 moves at a speed of 111 cps (characters per second) which is equal to 11.1 inches per second.

The print head 1 faces a cylindrical platen 5 which extends in parallel to the above-mentioned direction H. A recording medium in the form of a sheet S is wound around the platen 5. The print head 1 has twelve print wires on the printing surface thereof, as will be described specifically later. The twelve print wires are selectively thrusted out toward the platen 5 in response to a print wire drive signal fed to the print head 1 over a flat cable 3. An ink ribbon is fed out of the cassette 1' to the printing surface of the print head 1.

While the print head 1 is moved in the direction H by the motor 6, the print wires of the head 1 are selectively driven to print a desired character or image on the sheet S. In the illustrative embodiment, the platen 5 has a length L of 426 millimeters and made of SBR (Stylene Butylene Rubber) having a hardness of 98 degrees.

Figure 2A:
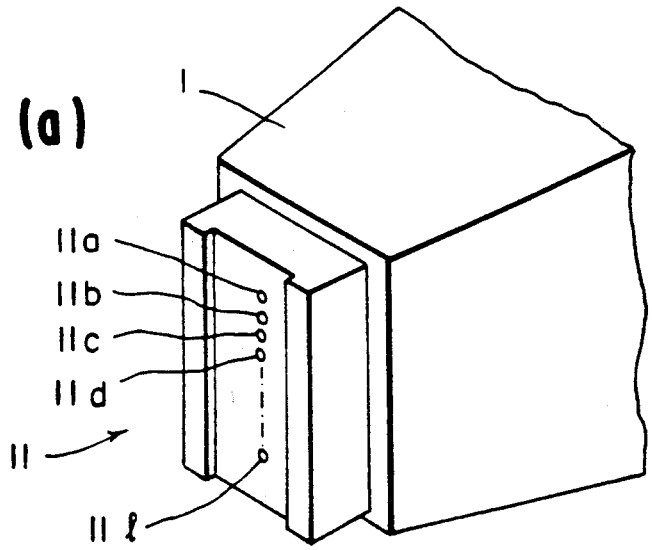
FIGS. 2(*a*) and 2(*b*) are a perspective view and a front view, respectively, showing a print head included in the embodiment shown in FIG. 1.
Figure 2B:
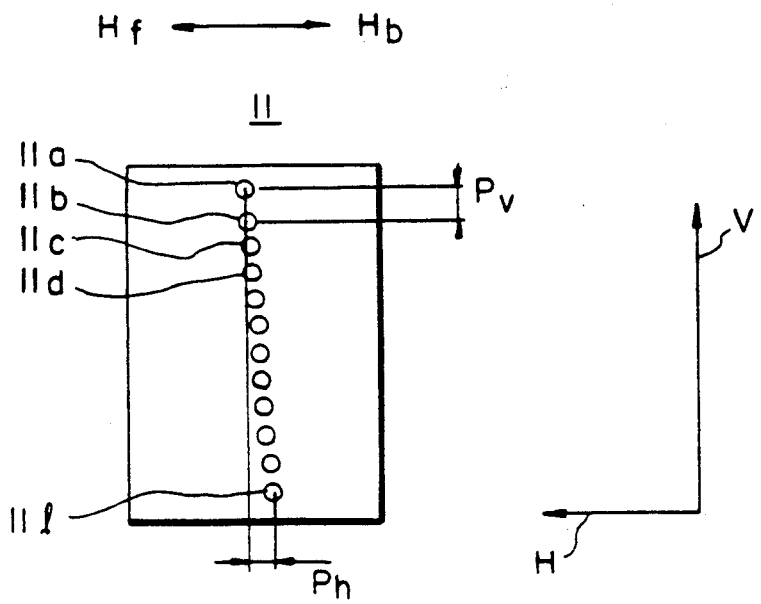

As shown in FIGS. 2(*a*) and 2(*b*), print wires 11*a*, 11*b*, 11*c*, 11*d*, . . . , 11*l* are arranged in a substantially vertical array on the printing surface 11 of the print head 1 which faces the platen 5. The line formed by the tips of the wires 11*a*–11*l* is inclined relative to the vertical line V which is perpendicular to the moving direction H of the print head 1.

The printing surface 11 of the print head 1 appears as shown in FIG. 2(*b*) when viewed from the platen 5 side. In FIG. 2(*b*), the print wires 11*a*–11*l* are arranged at the same pitch Pv of 1/180 inch in the direction of the vertical line V. The uppermost wire 11*a*and the lowermost wire 11*l* are spaced apart from each other by a distance Ph of 1/195 inch in the moving direction H of the print head 1. The wires 11*b*, 11*c*, 11*d*, . . . intervening between the wires 11*a* and 11*l* are spaced apart by the same pitch in the direction H.

Figure 3A:
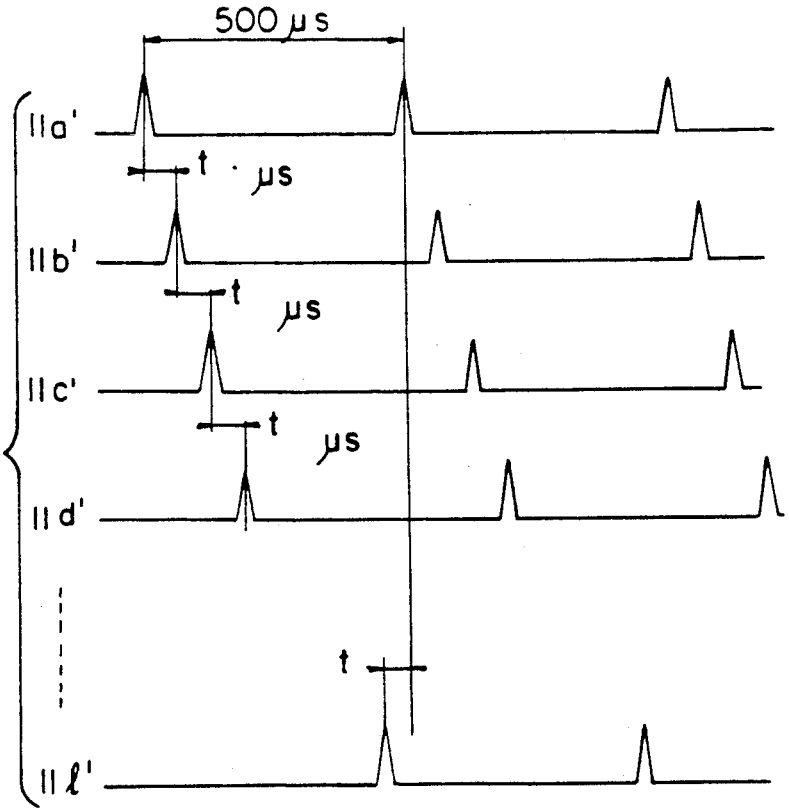
FIGS. 3(*a*) and 3(*b*) are graphs showing a drive timing of the embodiment shown in FIG. 1 and a drive timing of a conventional printer, respectively.
Figure 3B:
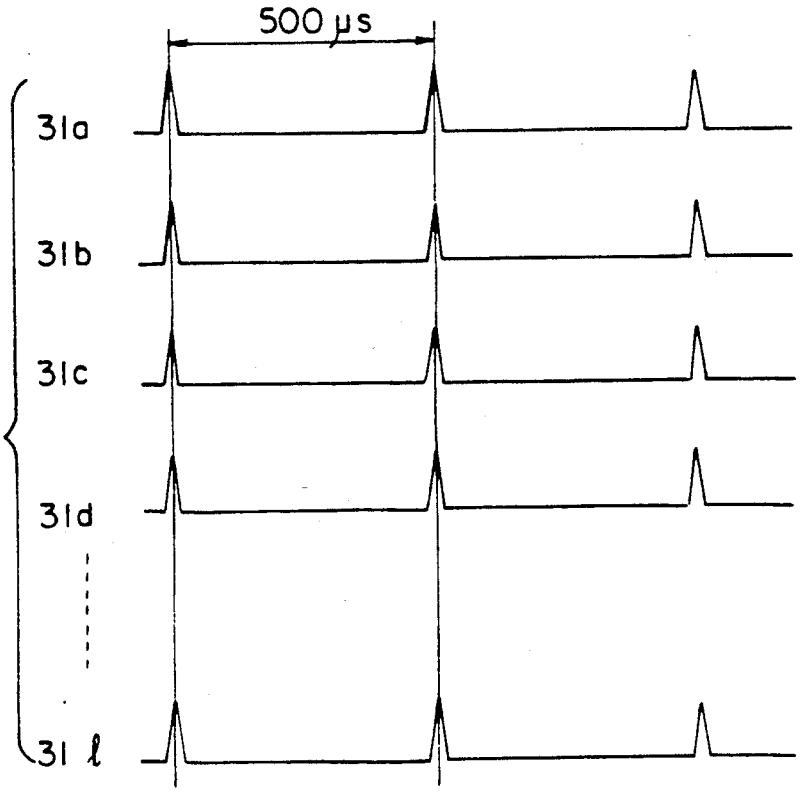
FIG. 3(b) PRIOR ART

The timings for driving the print wires 11*a*–11*l* will be described with reference to FIGS. 3(*a*) and 3(*b*) and on the assumption that they print lines parallel to the vertical line V continuously. FIGS. 3(*a*) and 3(*b*) relate to the printer of the present invention and the conventional printer, respectively.

In the illustrative embodiment, the drive period per one wire is 500 microseconds, and the platen roller 5 is made of SBR and has a length L of 426 millimeters and a hardness of 98 degrees. Then, the surface wave passes the surface of the platen 5 in the lengthwise direction L in 500 microseconds.

It has been customary with a conventional printer to drive all the print wires arranged in parallel to the vertical line V at the same time, as represented by waveforms 31*a*–31*l* in FIG. 3(*b*). This is undesirable because the platen of the printer causes surface oscillation to occur at the period of 500 microseconds, resulting in considerable noise.

By contrast, as shown in FIG. 3(*a*), the printer of the present invention drives successive ones of the wires 11*a*–11*l* at the same interval or time lag of t which is 500/12 microseconds, as represented by waveforms 11′*a*–11′*l*. The time lag of 500/12 microseconds is one-twelfth, i.e., less than one half of the time in which the surface wave passes the platen 5 in the lengthwise direction L. Consequently, the surface waves cancel each other to suppress the surface oscillation of the platen 5 and, therefore, the noise.

Figure 4:
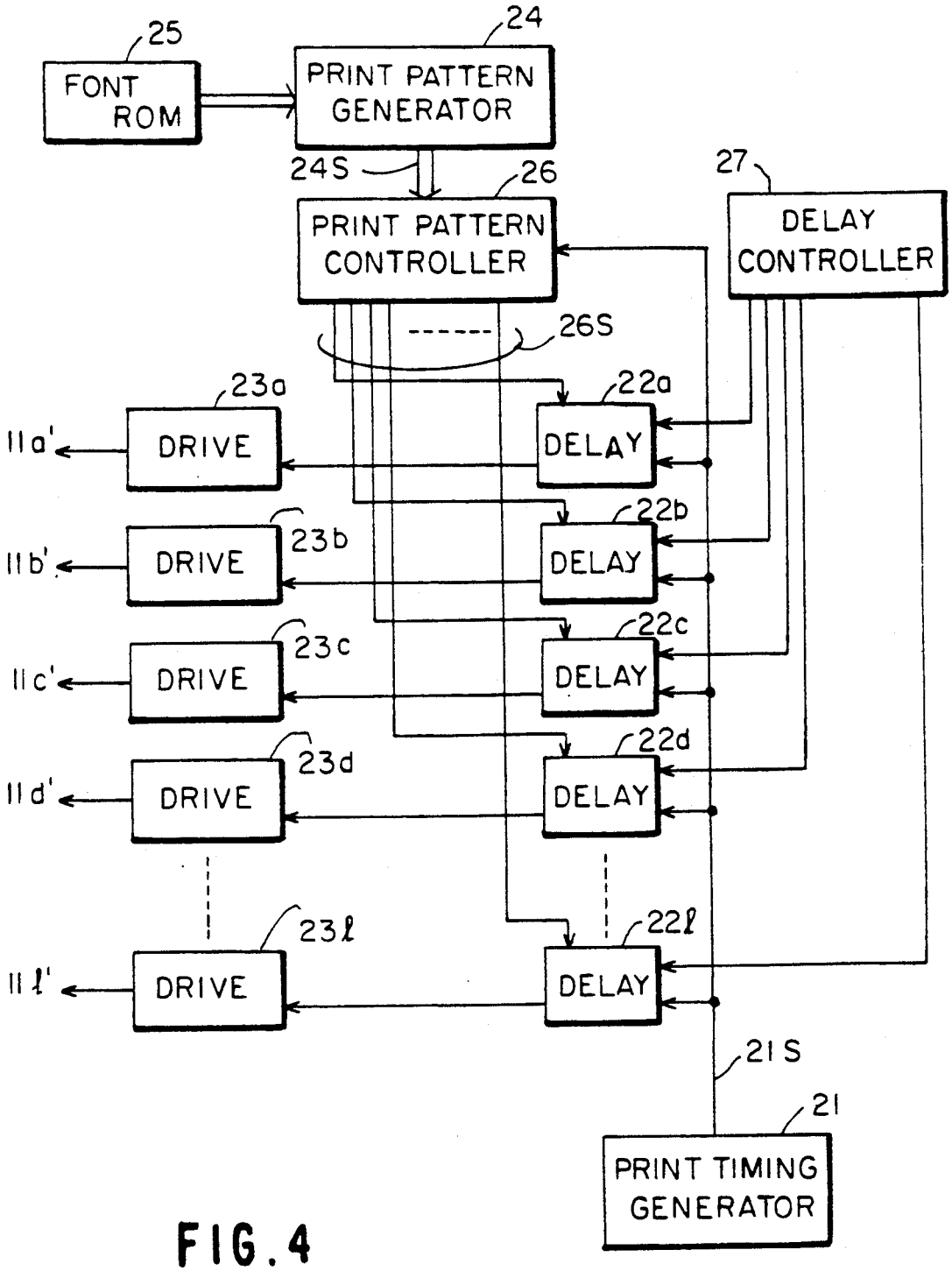
FIG. 4 is a block diagram schematically showing a specific construction of circuitry included in the embodiment shown in FIG. 1 for generating drive timing signals.

FIG. 4 shows a specific construction of circuitry for generating the above-mentioned drive timings 11′*a*–11′*l*. As shown, the circuitry has a print timing generating circuit 21 which generates a print timing signal 21S for driving the print wires 11*a*–11*l*. Delay circuits 22*a*, 22*b*, 22*c*, 22*d*, . . . , 22*l* each delays the print timing signal 21S and delivers the resulting delayed signal to associated one of print wire drive circuits 23*a*, 23*b*, 23*c*, 23*d*, . . . , 23*l*. A print pattern generating circuit 24 generates a print pattern signal 24S in response to data fed thereto from a font ROM 25. The print pattern signal 24S is fed to particular ones of the delay circuits 22*a*–22*l* via a print pattern control circuit 26. A delay control circuit 27 controls the delay time of each of the delay circuits 22*a*–22*l* so that particular ones of the delay circuits 22*a*–22*l*, when selected by the print pattern control circuit 26, delay the print timing signal 21S by a respective delay time and, then, deliver the delayed signal to associated one of the print wire drive circuits 23*a*–23*l*. The print pattern control circuit 26 starts operating in response to the print timing signal 21S and feeds, based on the print pattern, a selection signal 26S to particular ones of the delay circuits 22*a*–22*l* which are associated with the wires to be driven.

In operation, while the print head 1 is moved in the forward direction Hf (FIG. 1) to print an image of a vertical line, the delay control circuit 27 sets delay times of 0, t, 2t, 3t, ..., 11t (t=500/12 microseconds) in the delay circuits 22*a*, 22*b*, 22*c*, 22*d*, . . . , 22*l*, respectively. As a result, drive signals 11′*a*–11′*l* are sequentially applied to the print head 1, causing the print wires 11*a*–11*l* to drive in the order shown in FIG. 3(*a*). Since the print head 1 sequentially drives the wires 11*a*–11*l* while moving in the forward direction Hf, a line parallel to the vertical line V is printed on the sheet S.

When the print head 1 is moved in the backward direction Hb to print an image, the delay control circuit 27 sets delay times of 11t, 10t, 9t, 8t, . . . , 0 in the delay circuits 22*a*, 22*b*, 22*c*, 22*d*, . . . , 22*l*, respectively. As a result, the drive signals 11′*l*–11′*a* are sequentially applied to the print head 1, causing the print wires 11*l*–1-1*a*to drive in the opposite order to the order shown in FIG. 3(*a*). The head 1, therefore, prints a line parallel to the vertical line V on the sheet S.

In the specific case described above, all the print wires 11*a*–11*l* are driven to print a vertical line on sheet S. Of course, the wires 11*a*–11*l* may be selectively driven on the basis of a pattern to be printed, i.e., they can print any desired pattern on the sheet S.

Figure 5A:
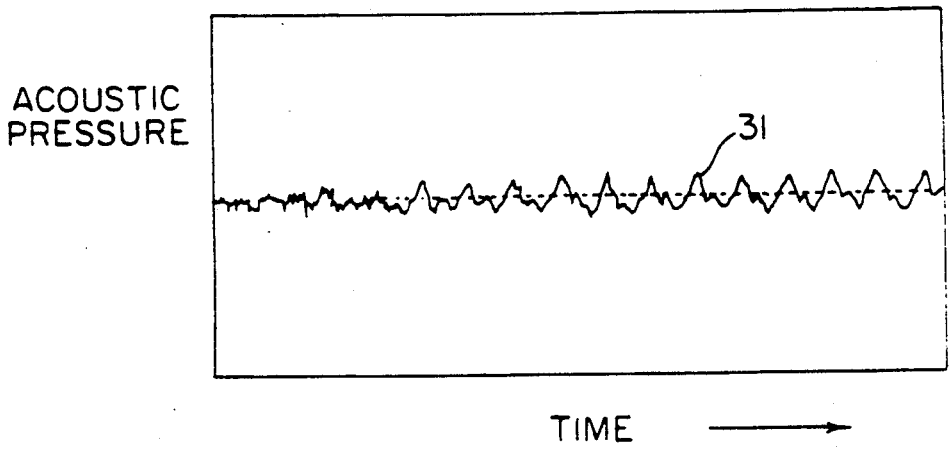
FIGS. 5(*a*) and 5(*b*) are graphs showing the waveforms of acoustic pressure of the embodiment and a conventional printer, respectively.
Figure 5B:
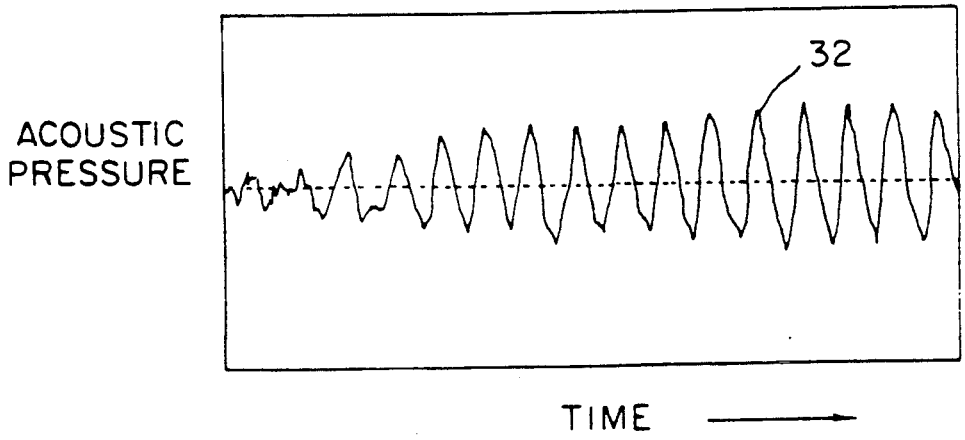
FIG. 5(b) PRIOR ART

FIGS. 5(*a*) and 5(*b*) show the waveforms of acoustic pressure of the printer of the present invention and the conventional printer, respectively, each measured at the beginning of a printing operation at a portion 200 millimeters just above the printing surface 11. As shown, the waveform 32 of the conventional printer sequentially increases in amplitude while the waveform 31 of the printer of the present invention has small amplitudes. Regarding the noise level, the conventional printer and the printer of the present invention were measured to be 97 dB(A) and 85 dB(A), respectively.

It is to be noted that the present invention is practicable with a dot impact type printer having any desired number of print wires other than twelve shown and described. Also, the circuitry shown in FIG. 4 is only illustrative and not limitative.

In summary, it will be seen that the present invention provides a dot impact type serial printer which reduces noise by driving successive ones of print wires thereof at an interval less than one-half of the time in which the surface wave of a platen passes the platen in the lengthwise direction of the latter.

What is claimed is:

1. A method for driving a plurality of print wires arranged on a print head of a dot impact type serial printer which includes a platen, said method comprising the steps of:

determining a time required for a surface wave, caused by impact of tips of said print wires on said platen, to pass across said platen in a lengthwise direction of said platen;

determining an interval for driving successive ones of said print wires based upon said time required for said surface wave to pass across said platen in said lengthwise direction, wherein said interval is less than one-half of said time in which said surface wave passes said platen in said lengthwise direction; and driving successive ones of said print wires at said interval.

2. The method as defined in claim 1, wherein said method further includes the step of driving said print head in a lengthwise direction to perform a printing operation.

* * * * *

UNITED STATES PATENT AND TRADEMARK OFFICE

CERTIFICATE OF CORRECTION

PATENT NO. : 5,310,270
DATED : May 10, 1994
INVENTOR(S) : Hiroyuki MATSUKURA

It is certified that error(s) appears in the above-identified patent and that said Letters Patent is hereby corrected as shown below:

Col. 2, line 63, delete "11*a*and" and insert --11*a* and--.

Col. 4, lines 8-9, delete "11*a*to" and insert --11*a* to--.

Signed and Sealed this

Twenty-fourth Day of January, 1995

*Attest:*

Bruce Lehman

BRUCE LEHMAN

*Attesting Officer*

*Commissioner of Patents and Trademarks*